United States Patent [19]

Vidal

[11] Patent Number: 4,557,634

[45] Date of Patent: Dec. 10, 1985

[54] WALL STRUCTURE AND METHOD OF CONSTRUCTION

[76] Inventor: Henri Vidal, 8 bis Boulevard, 92200 Neuilly-Sur-Seine, France

[21] Appl. No.: 566,471

[22] Filed: Dec. 28, 1983

Related U.S. Application Data

[63] Continuation-in-part of Ser. No. 457,160, Jan. 11, 1983, abandoned.

[51] Int. Cl.[4] ..... E02D 29/02; E02D 17/00; A01G 9/02

[52] U.S. Cl. ..... 405/286; 405/273; 405/284; 47/83

[58] Field of Search ..... 405/16, 19, 20, 31, 405/33–35, 262, 272, 273, 284–287; 52/169.4, 742; 256/19, 12.5; 47/47, 82, 83

[56] References Cited

U.S. PATENT DOCUMENTS

| | | | |
|---|---|---|---|
| 936,843 | 10/1909 | Wood | 405/286 |
| 2,880,588 | 4/1959 | Moore | 405/285 |
| 3,225,548 | 12/1965 | Hayden | 405/286 |
| 3,686,873 | 8/1972 | Vidal | 405/262 |
| 4,074,538 | 2/1978 | Janus | 405/284 X |
| 4,125,970 | 11/1978 | Vidal | 405/284 X |
| 4,229,123 | 10/1980 | Heinzmann | 405/286 X |
| 4,318,642 | 3/1982 | Barnett | 405/284 |
| 4,343,571 | 8/1982 | Price | 405/284 |
| 4,384,810 | 5/1983 | Neumann | 405/284 |

FOREIGN PATENT DOCUMENTS

| | | | |
|---|---|---|---|
| 2716250 | 10/1978 | Fed. Rep. of Germany | 405/284 |
| 3103849 | 9/1982 | Fed. Rep. of Germany | 405/284 |
| 610377 | 12/1979 | Switzerland . | |
| 222962 | 10/1968 | U.S.S.R. | 405/284 |

*Primary Examiner*—Cornelius J. Husar
*Assistant Examiner*—Nancy J. Stodola
*Attorney, Agent, or Firm*—Burns, Doane, Swecker & Mathis

[57] ABSTRACT

A retaining wall has precast concrete wall facing elements and is constructed to accommodate vegetation masking. The structure uses panels having frontally projecting buttresses and inwardly inclined face surfaces to provide an exposed horizontal planting bed for each row of panels. Devices are provided to limit water percolation and migration of fine particles. And, rearwardly projecting bearing pads may be added to give columnar support in high wall application.

14 Claims, 19 Drawing Figures

Fig. 2
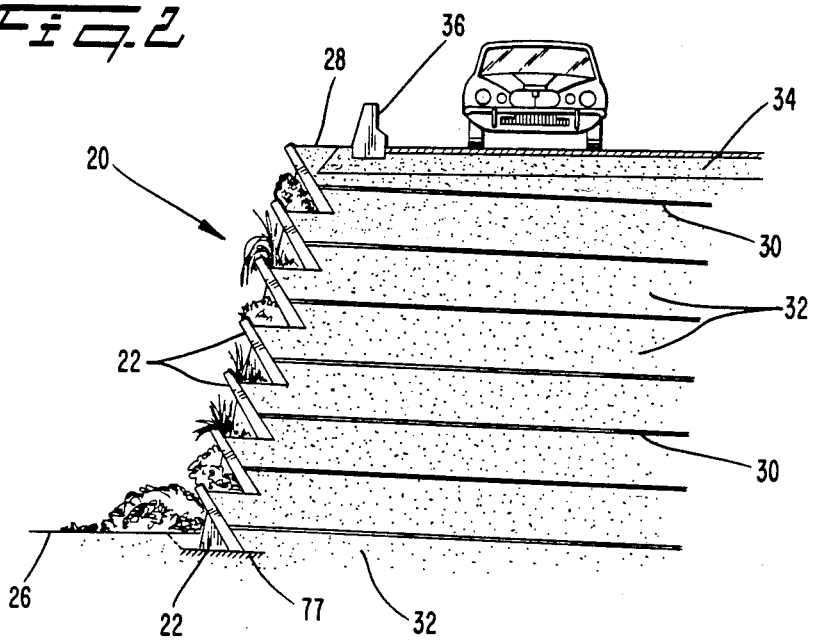
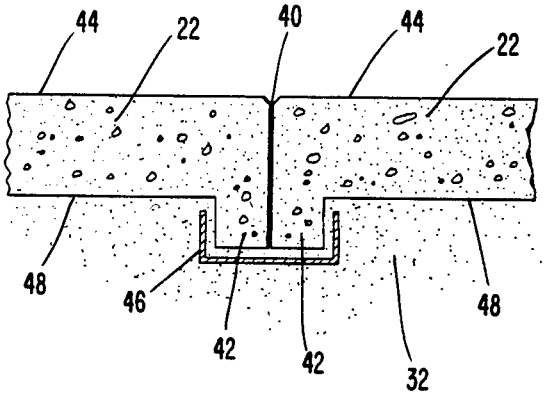
Fig. 3

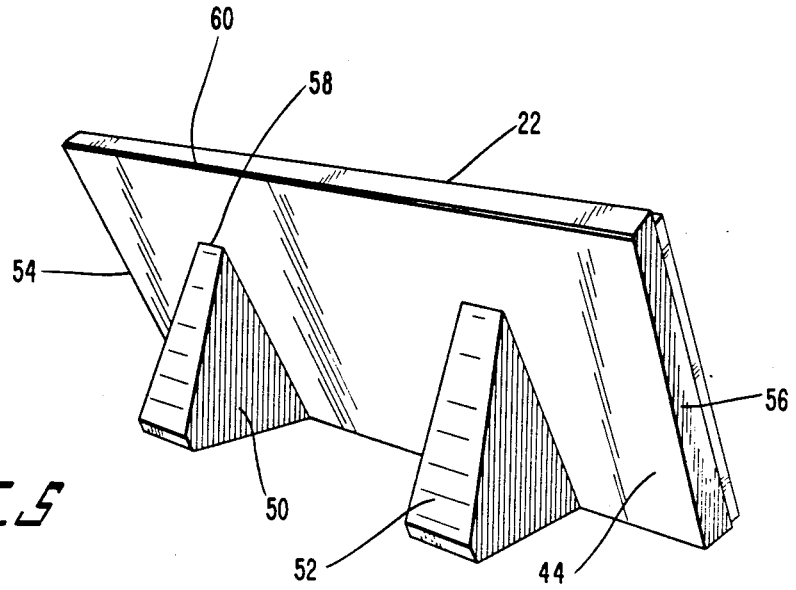
Fig. 5
Fig. 6
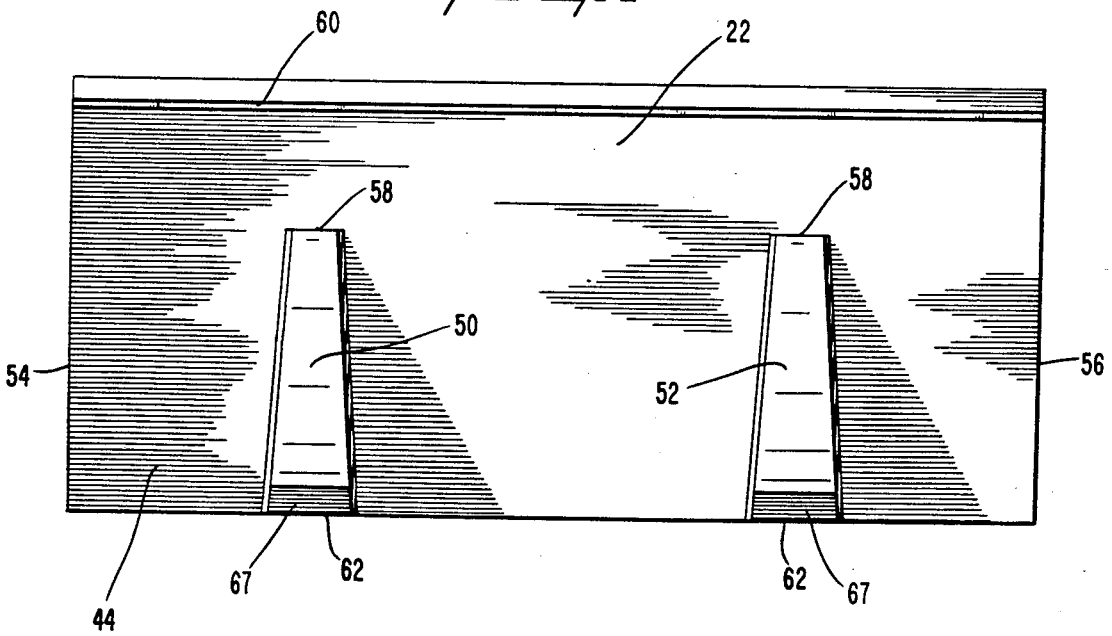

Fig. 9
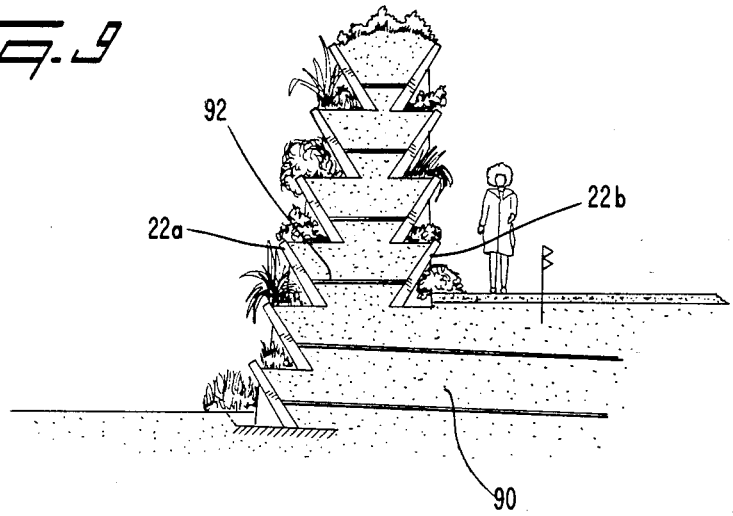
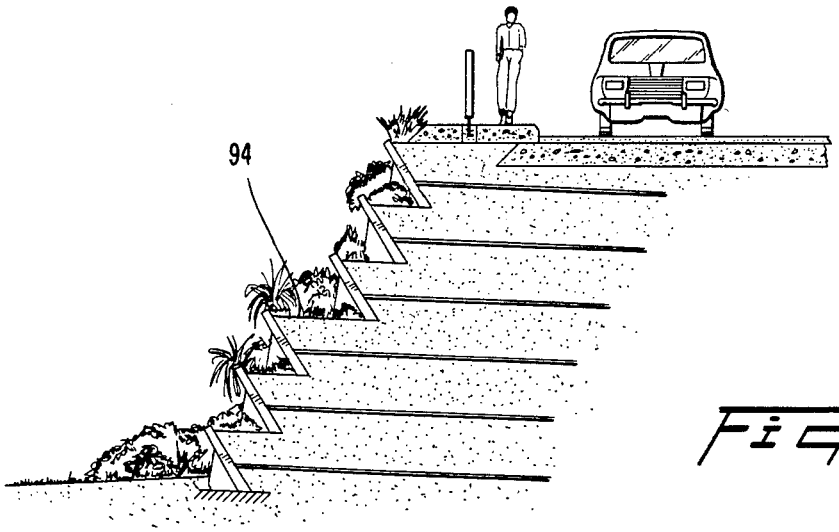
Fig. 10

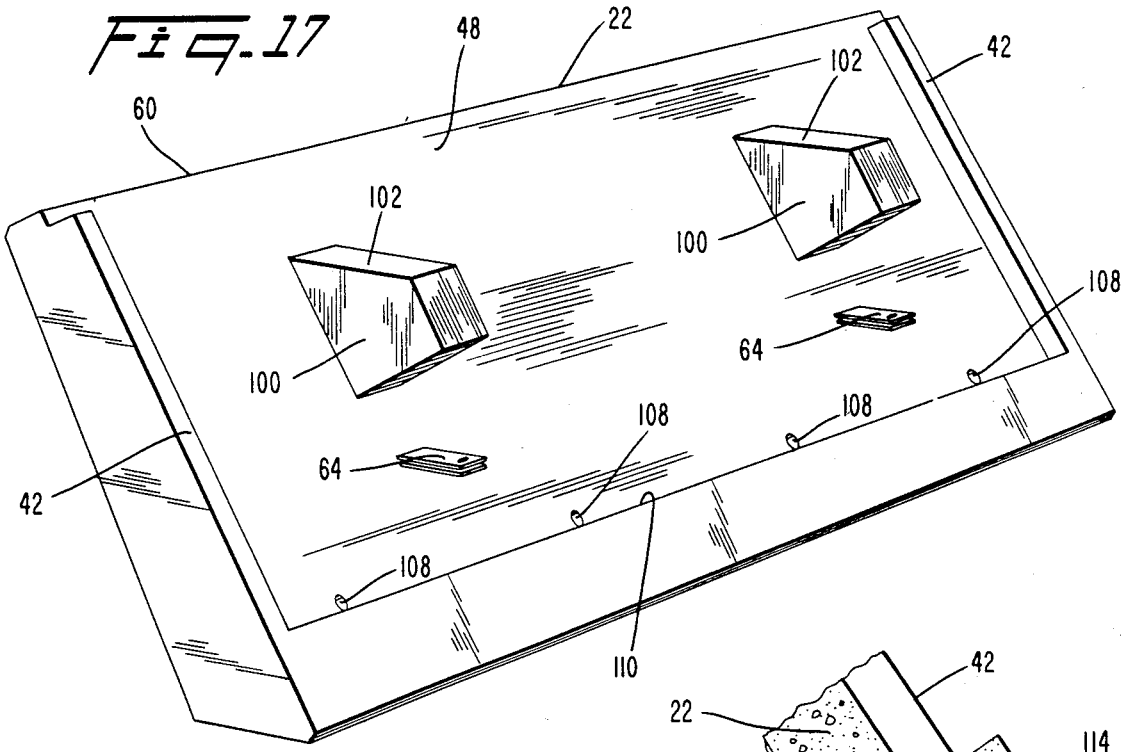
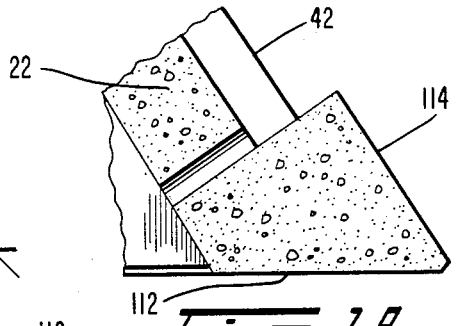
Fig. 19
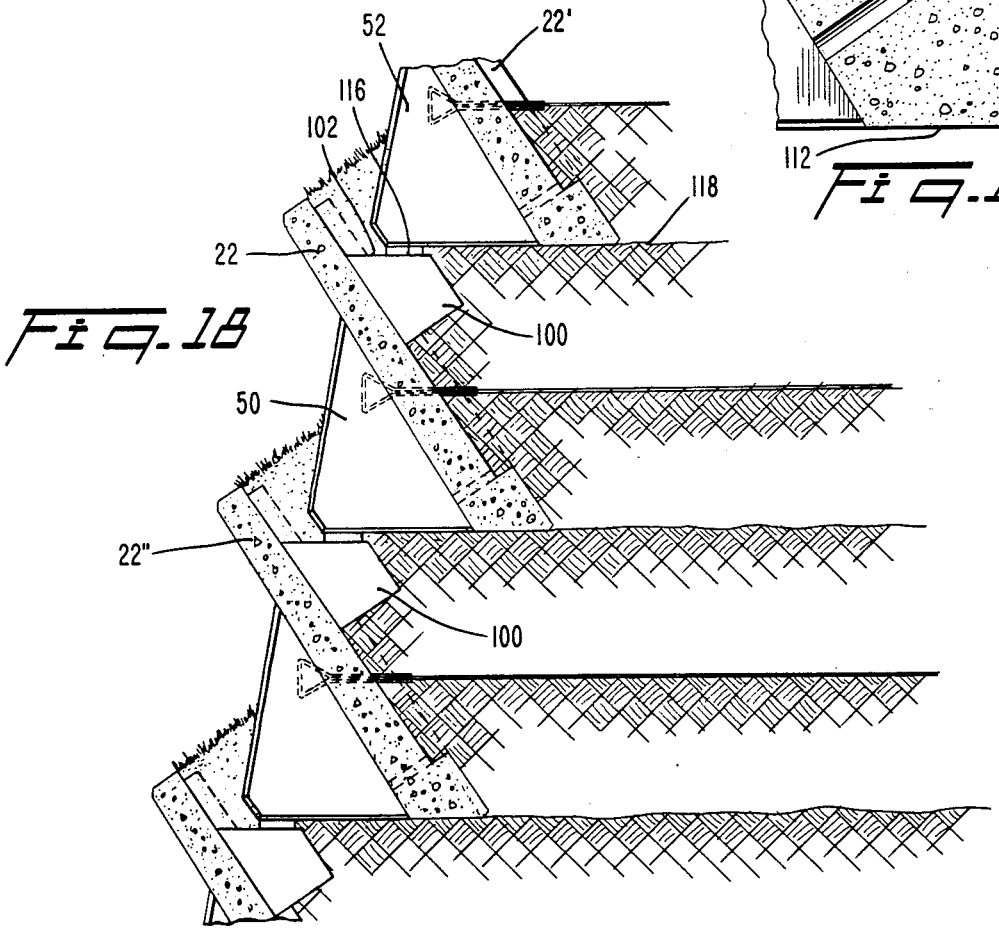
Fig. 18

WALL STRUCTURE AND METHOD OF CONSTRUCTION

CROSS REFERENCE TO RELATED APPLICATION

This is a continuation-in-part of copending U.S. Letters patent application Ser. No. 06/457,160, filed Jan. 11, 1983, by Henri Vidal, for a Wall Structure and Method of Construction, now abandoned.

BACKGROUND OF THE INVENTION

The present invention relates generally to a structure such as a retaining wall for providing an abrupt change in the elevation of a ground surface. More particularly, the present invention concerns to a new and improved wall facing and a method of construction whereby the wall face can be essentially covered with live plants.

Many years ago, a new and improved earth stabilization technique was developed and successfully marketed which makes use of precast concrete facing elements to cover the exposed face of a gravity structure created by a composite material. The composite material as fabricated from layers of particulate backfill material which alternate with layers of reinforcing members attached to the facing elements. Frictional interaction between the particulate soil and the reinforcing members stabilizes the composite material structure thereby creating a gravity wall. The foregoing technique is applicable to retaining walls and the foregoing description is generally covered by U.S. Pat. No. 3,421,326, issued Jan. 14, 1969 to Henri Vidal entitled Constructional Works.

The general technique of earth stabilization has also been employed in connection with gravity walls having an inclined face. In this instance, special wall facing elements were designed with a face that is generally parallel to the inclined face and which lies in the plane of the inclined surface. These wall facing elements provide a smooth wall surface and are positioned in the wall with a pair of generally triangular gussets that support the wall in its inclined position. Sloped walls using the general earth stabilization technique and wall facing elements for use in connection therewith are described in U.S. Pat. No. 4,125,970, entitled "Bulk Storage Facility," issued to Henri Vidal on Nov. 21, 1978.

Various other types of facings have also been contemplated for use in connection with stabilized earth structures of the type described. For example, it has been proposed to use commercially available precast bridge sections for a facing material by setting those sections on end and connecting them to the reinforcing elements. Such a facing has a pair of generally continuous vertical webs which project forwardly from the face of the wall. Such a facing structure has been described, for example, in the reports of an International Conference on Soil Reinforcement, see held Mar. 22, 1979 in Paris, France, Vol. II, pages. 447–48.

There have also been uses of the frictionally stabilized earth masses in terraced arrangements for use in walls. Examples of such terraced arrangements are the retaining walls constructed at Vail Pass, Colorado. In those retaining wall structures, the wall facing elements are generally concave with vertically extending cylindrical surfaces. Successive terraces were benched from one another with the result that a generally continuous concrete face is presented by the various retaining wall portions.

The various techniques of providing facings for frictionally stabilized earth structures have in the past been characterized by an essentially continuous concrete face which is either vertical or inclined at some angle relative to the vertical. Such face structures are not well suited for use in scenic environments where the presence of large exposed concrete faces is aesthetically unsuitable. Moreover, the hard generally planar face is not well suited for absorbing sound which would be reflected from the surface. And, such wall structures are very obvious when used as visual barriers or a security barriers.

To date, no frictionally stabilized earth structure has been available which provides a face that is capable of supporting growing plants to at least partially mask the underlying structure. In particular, there have been no precast concrete elements which have been suitable for such a wall.

To date, there has been no method of building a frictionally stabilized earth structure with a face that can be essentially masked by plants.

It is, therefore, an object of the present invention to provide a novel wall facing element which is adaptable for construction of a wall with a face essentially covered by plants.

Another object of the invention is to provide a wall which can have a vertical face that is masked by plants.

It is a further object of the present invention to provide a wall facing which can have sound absorbing properties and which is uniquely adapted for situations where concrete faced retaining walls are unsuitable.

These hitherto desirable but unavailable features are now provided by a wall erected with facing elements that provide an inclined surface which extends into the wall face itself and provides generally horizontal ledges running longitudinally along the wall. These ledges are well suited for various plantings that can partially or entirely mask the wall face, that may grow to a height approximately coextensive with the wall facing panels themselves or that may hang downwardly over the facing panel below. For vertical support, each facing panel is provided with a buttress that projects forwardly from the panel but not beyond the vertical plane passing through the upper edge of each panel. In this fashion, the wall can have successive horizontal rows of wall facing panels which present a vertical face or an inclined face, as desired.

In order to reduce the bearing pressure of the wall facing elements on the underlying soil material, the buttress may be provided with a downwardly increasing width so that a larger bearing area is provided to support the facing element.

To enhance the ability of the wall to support the vegetative material, a layer of topsoil may be placed along the horizontally extending area at the base of each row of wall facing elements. This topsoil may, in fact, be banked toward the face surface of the wall facing panels, as desired.

In some instances, to avoid percolation of surface water through vertically extending joints between adjacent wall facing panels, each wall facing panel may be provided on its back surface with a pair of ribs, each rib being positioned adjacent to a vertical edge. With panels in sidewise adjacent relationship, a channel member that may be generally U-shaped is positioned over the projecting ribs of adjacent panels to cover the vertical joint therebetween. In this manner, ground surface water which percolates down the rear surface of the wall facing elements is channeled into the particulate backfill material by the large channels defined between the ribs of each panel.

BRIEF DESCRIPTION OF THE DRAWINGS

The above, as well as many other objects and advantages of the present invention, will be apparent to those skilled in the art when this specification is read in conjunction with the attached drawings wherein like reference numerals have been applied to like elements and wherein:

FIG. 2 is a typical cross-sectional view through a wall constructed in accordance with the present invention;

FIG. 3 is a view in partial cross-section taken through a vertical joint between adjacent wall facing elements of FIG. 1;

FIG. 5 is a perspective view of a wall facing element;

FIG. 6 is a frontal elevation of the wall facing element of FIG. 5;

FIG. 9 is a partial cross-sectional view taken through a wall providing a visual barrier;

FIG. 10 is partial cross-sectional view of a retaining wall structure in which successive portions of the wall are terraced;

FIG. 17 is a perspective view of the facing element of FIG. 15 viewed from the back;

FIG. 18 is a partial cross-sectional view taken through a wall constructed with facing elements of FIG. 15; and FIG. 19 is a detail view of an alternate base arrangement.

DESCRIPTION OF THE PREFERRED EMBODIMENTS

Figure 1:
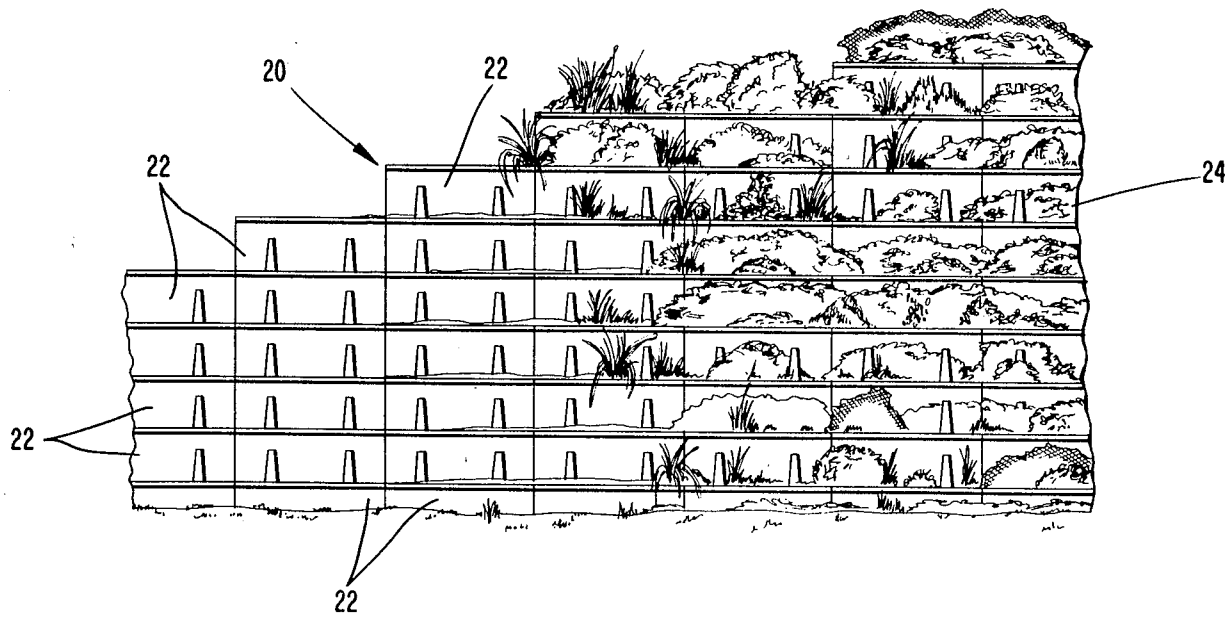
FIG. 1 is a pictorial elevational view of the plant covered wall in accordance with the present invention.

A plant covered retaining wall structure 20 (see FIG. 1) has a plurality of rows of wall facing elements 22. Each row is generally horizontal and successive rows are stacked vertically one upon the other. The wall facing elements 22 may be arranged so as to also lie in generally vertical columns.

These wall facing elements 22 provide a unique generally horizontal ledge or area at the bottom of each horizontal row which is suited for the planting of various plants 24. Preferably, the type of plants 24 is selected so that they have a mature height approximately coextensive with the vertical height of the wall facing elements 22. Alternatively, the plants are selected so that they will drape downwardly over the wall elements therebelow. In this fashion, the plants 24 essentially mask the underlying concrete surface of the wall facing elements 22 and present a natural looking surface. If desired, the plants may be an evergreen variety so that the wall facing elements are masked throughout the year. Moreover, it is within the scope of this invention that the plants 24 do not entirely mask the underlying wall structure.

The covered retaining wall structure provides a retaining wall having a surface that is aesthetically pleasing and is adapted for use in environments where the presence of large concrete surface is either unacceptable or undesirable. In addition, the plants on the surface combined with the shape of the wall facing elements 22 provides a barrier that can absorb incident sound and noise without reflection back toward the observer. This result is accomplished by the absorptive qualities of the vegetation coupled with the inclined face of the wall facing element 22. Moreover, the unimpeded access to soil behind the wall face itself, promotes growth of roots into that soil thereby stabilizing the soil face.

The wall itself (see FIG. 2) provides an abrupt change in ground surface elevation from the bottom of the wall 26 to the top of the wall 28. Abrupt elevational changes such as that illustrated in FIG. 2 may be useful or desired where elevated roadways are necessary and where sound or visual barriers are needed.

As noted, the wall 20 has a face composed of a plurality of horizontal rows of wall facing elements 22. Each wall facing element 22 is connected to one or more reinforcing members 30 which extend rearwardly from the wall facing element 22 into the earth mass located therebehind. The suitable reinforcing members are numerous, see, for example, U.S. Pat. No. 3,421,326, which is incorporated herein by this reference thereto. Elongated metal strips, metal grids and similar devices have been found to be particularly well suited for reinforcing members in stabilized earth structures but it will be appreciated that this invention is not limited to those devices.

The earth mass immediately behind the wall facing elements 22 is preferably a free draining particulate material which extends to a depth behind the wall roughly coextensive with the length of the reinforcing members 30. The presence of the reinforcing members 30 between layers 32 of particulate material frictionally stabilizes the particulate material 32 so as to define a gravity structure having dimensions essentially coextensive with the height of the wall 20 and the length of the reinforcing members 30.

At the top of the wall 20, a suitable conventional roadway 34 may be provided having suitable conventional traffic barriers 36 for automobile safety. Many other possible structures for use at the top of the wall are also within the teaching of this invention. For example, most other civil engineering structures could be placed at the top of the retaining wall as could dwellings, buildings, recreation areas and the like.

It will be appreciated that the vertical joints between adjacent wall panels 22 (see FIG. 1) provide a potential crevice through which surface water may percolate and through which fine particles of the particulate material backfill can migrate to blemish and possibly stain the faces of the wall facing elements. Accordingly, a means is provided to eliminate this undesirable result. Generally (see FIG. 3), each wall facing element is provided with a rib 42 which projects rearwardly away from the face surface 44, along each vertical joint 40. Each pair of ribs 42 adjacent to a vertical joint 40 is covered by a U-shaped member channel 46 which extends vertically along the length of the joint 40. The channel 46 is positioned on the back surface of the wall facing elements 22 and may be fabricated from a suitable plastic material so that corrosion and degradation from the corrosive effect of ground waters does not cause its deterioration. The channel 46 is sized to cover both of the ribs 42 and causes ground water to drain downwardly along the back surface 48 of each wall facing element 22. Moreover, the channel 46 is sufficiently wide to accommodate a small gap between adjacent facing elements or to accommodate for misalignment between the elements.

Figure 13:
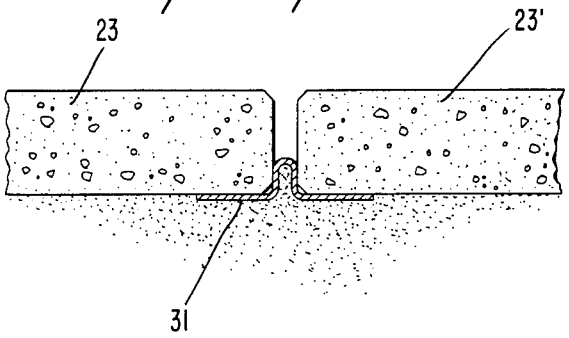
FIG. 13 is a partial cross-sectional view taken through a second embodiment of a vertical joint between adjacent wall facing elements.

An alternate vertical joint arrangement is illustrated in FIG. 13. The wall facing elements 23, 23', are the same as the wall facing elements 22 except that there is no vertical rib adjacent the vertical joint. A strip of joint covering material 31 extends vertically along the back surface 48 of the elements 23 at the joint. This material 31 may be rubber, plastic or metal and, as shown, may protrude into the joint itself.

The details of each wall facing element 22 will now be described more fully. Each wall facing element 22 includes a face surface 44 (see FIG. 5) which is generally rectangular. While the face surface 44 is shown in the drawings as rectangular, many other shapes can also be used advantageously. As one example, where curved elements are used to provide curved wall, the projection of the face surface 44 would be generally trapezoidal. Projecting forwardly out of the face surface 44 are a pair of buttresses 50, 52. The buttresses 50, 52 give vertical support to the face element 22 with the face surface 44 in an inclined position.

Figure 14:
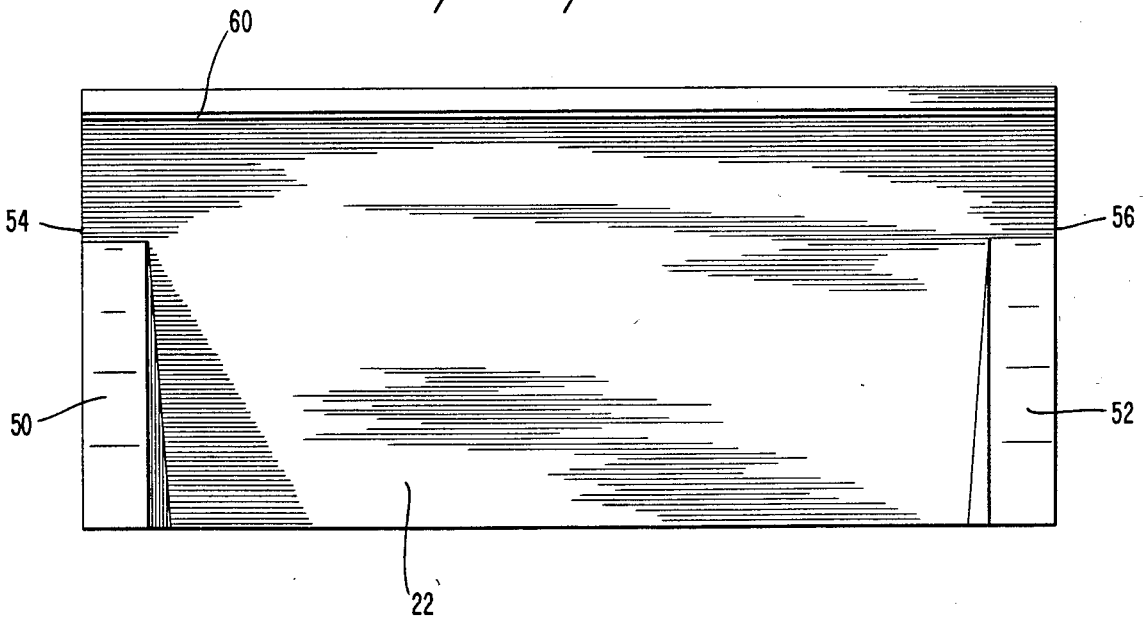
FIG. 14 is a front elevational view of an alternate buttress spacing.

The center of each buttress 50, 52 is spaced from the adjacent generally vertical edge 54, 56, respectively, by a distance approximately equal to one-fourth the length of the wall facing panel 22. Accordingly, the center of each buttress 50, 52 is spaced from the other buttress by approximately one-half the length of the wall facing panel 22. With this spacing, the buttresses 50, 52 of adjacent wall facing elements 22 are generally uniformly spaced when the wall is fully erected (see FIG. 1). This uniform spacing is one of many possible arrangements for the buttress spacing, random spacing as well as asymmetric spacings and alternate regular spacings are also possible. For example, the buttresses 50, 52 could be spaced such that each is located at a vertical edge of the wall facing element 22 so that, in the wall, the two buttresses would appear to be a single buttress FIG. 14). Moreover, special wall facing elements, such as those at corners, may have a buttress spacing different from the standard wall facing element.

In the illustrated embodiment of the wall facing element (FIG. 6), the upper edge 58 of each buttress 50, 52 is preferably spaced vertically below the front edge 60. This positioning of the upper edge 58 causes each buttress 50, 52 to have a height approximately coextensive with the layer of particulate backfill material located behind the wall facing panel 22. In addition, this location provides the aesthetically pleasing result of an appearance of discontinuous facial supports for the various wall facing elements 22 (see FIG. 1). The thickness of the buttress 50, 52 in the illustrated embodiment (see FIG. 6) increases vertically downwardly away from the upper edge 58. In this fashion, an enlarged bearing surface 62 is provided at the bottom of each buttress. This bearing area 62 is the vertical support which holds the wall facing element 22 in its proper orientation in the wall structure.

The end of each buttress 50, 52, which is remote from the face surface 44, is preferably provided with a flattened or truncated surface 67. This truncated surface 67 (see FIG. 8) is arranged to be generally parallel to the back surface 48 of the wall facing element 2. With this arrangement, should settlement occur between vertically adjacent wall facing elements 22, the buttress 52 of the vertically superjacent wall facing element will not present an edge where contact forces are concentrated on the back surface 48 of a vertically subjacent wall facing element 22. Any pressure on the lower element 22 caused by settlement will be distributed over a considerably wider area of the lower wall facing element 22 due to the presence of the truncated surface 67, thereby substantially reducing the tendency of any wall facing element to fail during settlement.

Figure 11:
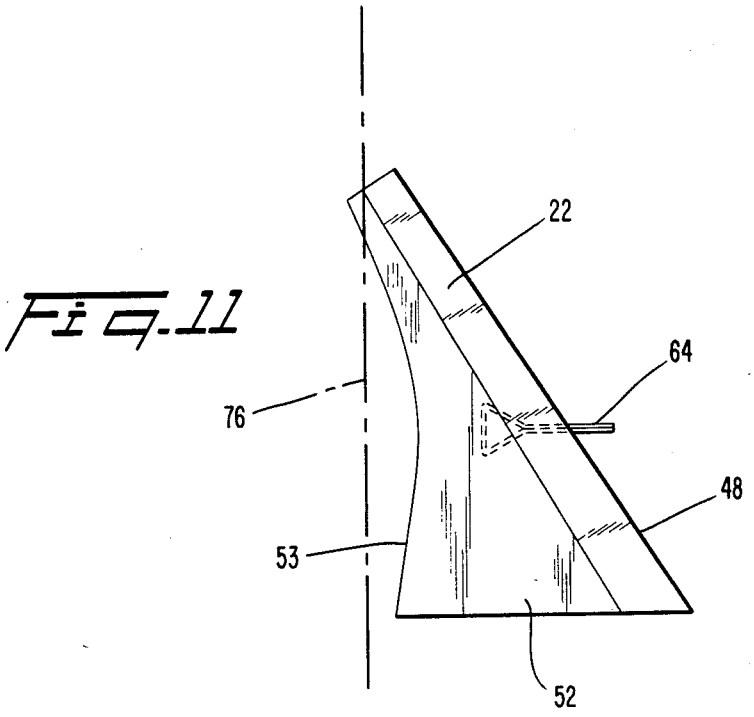
FIG. 11 is a side elevation of a second embodiment of a wall facing element.
Figure 12:
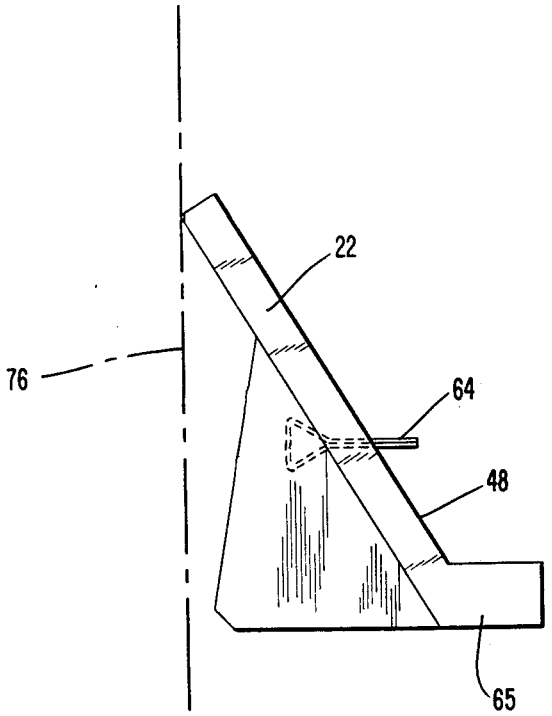
FIG. 12 is a side elevation of a third embodiment of a wall facing element.

Two of the many possible alternate embodiments of the wall facing element 22 are illustrated in FIGS. 11 and 12. In FIG. 11, the buttress 52 has a front surface 53 which is curved in the cross-sectional vertical plane which is generally perpendicular to the body portion of the facing element. In FIG. 12, the body portion of the wall facing element 22 has a uniform thickness but is provided with a horizontally extending rib 65. This rib 65 extends along the bottom edge of the wall facing element and projects rearwardly and away from the back surface 48. Such a rib 65 may be useful to strengthen the wall facing element 22.

Figure 7:
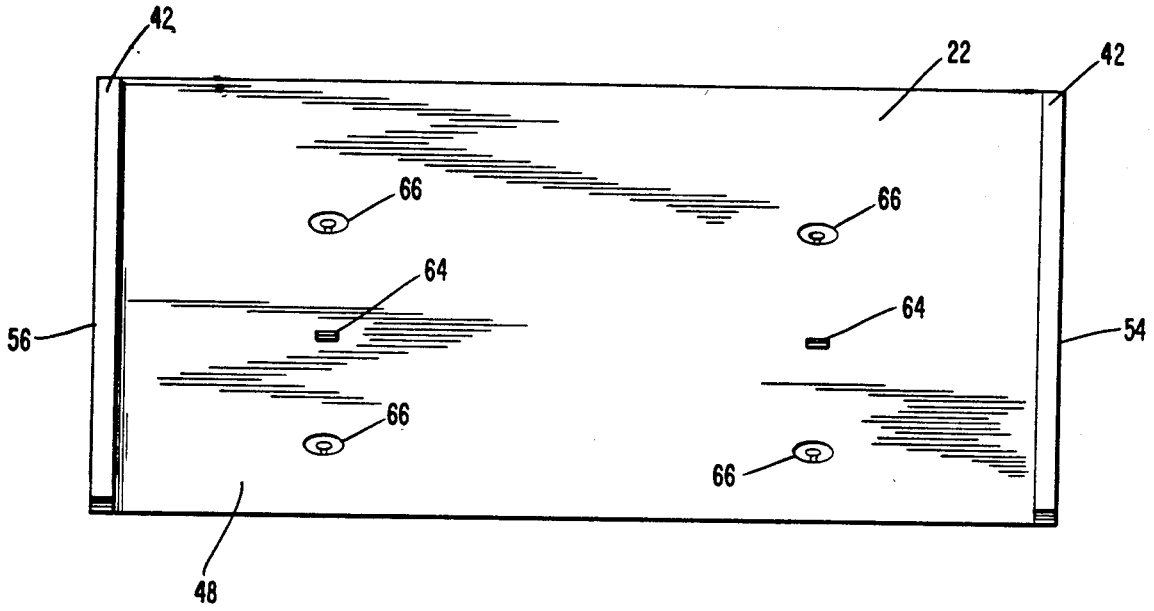
FIG. 7 is a rear elevation of the wall facing element of FIG. 6.

At the back surface 48 (see FIG. 7) of the wall facing element 22, the projecting ribs 42 are positioned. Each rib 42 is positioned adjacent to and parallel to a corresponding vertical edge 54, 56 of the wall facing element 22 as noted above. Between these ribs 42, the back surface 48 presents a generally U-shaped channel to direct any ground surface water that may percolate downwardly. In addition, the back surface 48 of the facing element 22 is provided with a pair of lugs 64. Each lug 64 is embedded in the concrete of the wall facing element 22 and projects rearwardly from the back surface 48. The lugs 64 are uniquely adapted for attachment to reinforcing elements which frictionally stabilize the particulate soil material located behind the wall face.

These lugs 64 are preferably spaced on the panel with respect to its width in generally the same fashion that the buttresses 50, 52 (see FIG. 6) are positioned on the exposed face of the panel. In addition, this location of the lugs 64 (FIG. 8) permits that portion of the lug cast in the wall facing element to project forwardly into the corresponding buttress 50, 52 (see FIG. 8). In this fashion, the wall facing thickness between the front face 44 and the rear face 48 of the wall facing element 22 may be selected without consideration of the necessary pull-out resistance for the lug 64 since the concrete in both the buttress 52 and the main body portion of the wall facing element 22 surrounds the lug 64.

The wall facing element (see FIG. 7) is also provided in its rear surface 48 with a plurality of lifting points 66. For convenience in balancing the wall facing element 22 during lifting and placement operations, preferably four of the lifting points 66 are provided. These lifting points 66 are also useful to lift the wall facing elements from casting molds and to move the facing elements during storage. Generally, two lifting points are positioned adjacent each lug 64, one attachment point being above the lug 64 and the second attachment point 66 being provided below the lug 64. Each attachment point 66 may include, for example, a metal stud 68 (see FIG. 8) which is cast in the body portion of the wall facing element 2 and which has a head portion 70 that projects into a recess 72 provided in the back surface 48 of the wall facing element 22. These integral lifting attachment points 66 avoid the need to use special handling equipment for placement of the wall facing panels 22.

Figure 8:
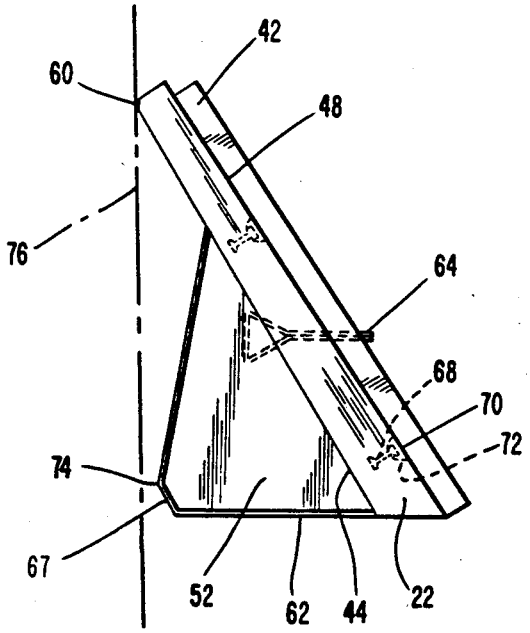
FIG. 8 is a side elevation of the wall facing element of FIG. 6.

It will also be noted from FIG. 8 that the forward edge 74 of the buttress 52 does not project beyond vertical plane 76 which passes through the front edge 60 of the wall facing element 22. With this arrangement, the slope of the wall face between vertically adjacent wall facing elements can be defined by the position of the front edges 60 for the wall facing elements 62. Simultaneously, the design assures that, during settlement, the forward edge 74 of the buttress 52 will not engage a lower wall element and cause the wall facing element 22 to be rotated about a horizontal axis passing longitudinally through the wall facing element 22.

The slope of the wall face between vertically adjacent wall facing panels can take virtually any angle. More specifically, the slope of the adjacent wall facing panels can be in the vertical plane 76 (FIG. 4) or can recede from that vertical plane at any angle (the angle being measured from the vertical plane 76 to the plane 78). Still further, the wall face slope can vary between successive vertically adjacent wall facing panels, if desired. Stated differently, there can be different wall face slopes in a single structure.

The method of constructing a wall in accordance with the present invention will now be described. The wall site is prepared by providing an excavation having the necessary depth (behind the wall face) to receive the reinforcing elements 30 (see FIG. 2). Thereafter, a level footing 77 is prepared. This footing may be made of concrete or may be made by leveling he excavation itself. The first horizontal row of wall facing elements 22 is then positioned on the footing 77 which extends longitudinally along the wall. Next, a lift 32' of particulate material is placed behind the row of wall facing elements 22 and compacted. This lift 32' has a thickness extending from the bottom of the facing element to the lugs 64 thereon. Next, a layer of reinforcing elements 30 is placed on top of the compacted layer of particulate material. Typically, these reinforcing members may be elongated strips having a generally rectangular cross section. Other suitable reinforcing members comprise mats and grids which may be connected to the wall facing elements 22.

References in this specification to reference numerals having suffixes of ', '', a, b, etc. refer to corresponding elements previously described in connection with the numeral. The suffixes are added for convenience in distinguishing different elements with the same reference numeral.

When the reinforcing elements have been placed and attached to the respective wall facing elements 22, a second lift 32' (see FIG. 4) of particulate material is placed behind the horizontal row of wall facing elements 22 and compacted. The second lift 32'' is placed on the layer of reinforcing members and has a thickness extending from the lugs to the elevation of the bottom edge of the wall elements 22, to be placed above. In the vicinity of the wall facing elements 22 the surface of the second lift 32'' is leveled to provide a foundation to receive the next vertically adjacent row of wall facing elements 22'.

The second row of wall facing elements 22' is then placed and positioned relative to the first row of wall facing elements 22 such that the frontal edge 60 of the first wall facing element 22 and the frontal edge 60' of the wall facing element 22' lies in a plane 78 which defines the intended angle of inclination of the finished wall face. It will be observed (see FIG. 4) that the plane 78 of the wall face may be inclined relative to the vertical plane 76 to the extent desired. In addition, it is possible that the frontal edges 68, 68, of vertically adjacent wall facing elements 22, 22' may lie in the vertical plane 76. This latter circumstance would exist when the wall is intended to present a precipitous vertical face.

With the second horizontal row of wall facing elements 22' positioned, a first lift 32, of backfill material is placed behind the wall facing panels 22' to a depth corresponding generally to the position of the lugs 64. After this first layer of particulate material is compacted, another layer or reinforcing members 30' is positioned on top of the lift 32' and attached to the lugs 64 projecting rearwardly from the wall facing elements 22'.

This sequence of positioning a row of wall facing elements, placing and compacting a lift of particulate material, arranging a layer of reinforcing members and attaching those members to the wall facing elements, depositing and compacting another layer of particulate material, leveling the compacted layer adjacent the wall face and positioning the next row of horizontal facing elements continues until the wall has attained its desired height.

Figure 4:
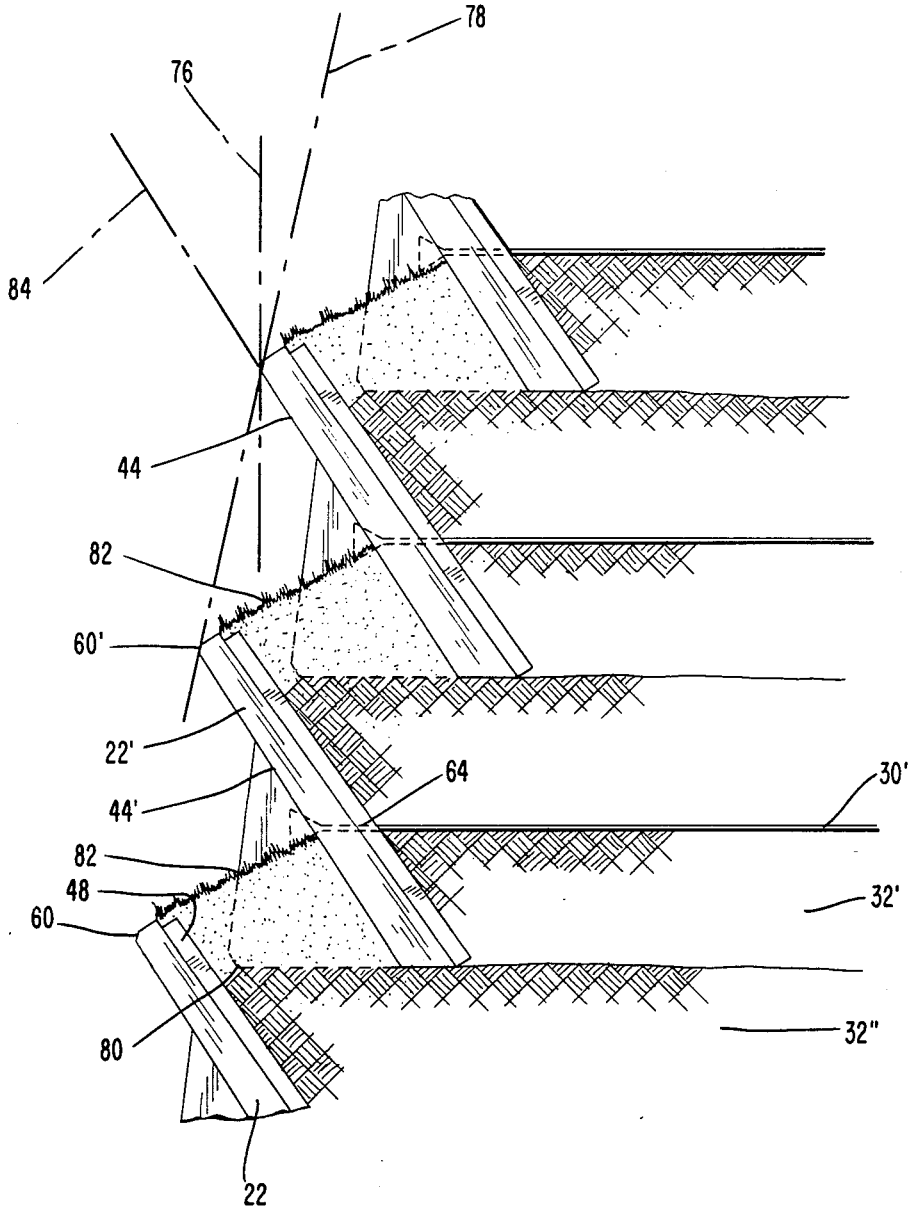
FIG. 4 is an enlarged cross-sectional view taken through the wall of FIG. 1.

It will be observed from FIG. 4 that the inclined frontal surface 44' of the wall facing element 22' and the rear surface 48 of the wall facing element 22 define a generally horizontal shelf-like area 80 on top of the compacted particulate backfill 32''. Similarly, each vertically adjacent pair of wall facing elements defines a horizontal area 80 which extends longitudinally along the length of the wall. This strip may then be covered with a layer of conventional top soil 82 which may be banked as illustrated or which may be simply level with the uppermost edge of the wall facing elements below. Having created a plurality of vertically spaced, longitudinally extending planting beds, the vegetative material 24 (see FIG. 1) may be planted with reasonable assurance that it will grow and thrive.

It will also be noted from FIG. 4 that the plane 84 in which the face surface 44 of the wall facing element lies is located at an angle to the plane 78 of the wall face. The angle between the plane of the wall face 78 and the plane 84 of the frontal surface 44 of a wall facing element must lie between (a) the angle between the vertical plane 76 and the plane 78 of the wall face and (b) an angle which is the sum of (i) 90°, and (ii) the angle between the vertical plane 76 and the plane 78 of the wall face. Preferably, the plane of the frontal surface 84 is about 30° from the vertical plane 76.

The angle between the plane 76 and the plane 78 is a measure of the batter of the wall. Moreover, this angle is a strong function of the land value where the structure is built: where the land value is high, this batter angle is low (as low as 0°); whereas, where land value is low, this batter angle may be high (as high as 90°).

Ordinarily, the low batter angles give more usuable land surface at the top of the wall.

There may be situations in which a comparatively narrow wall structure is desired. For example, such a situation may arise where a sound, visual or security barrier is desired (see FIG. 9). In such a situation, an underlying portion 90 of the wall structure may be constructed as described above. An upper portion of the wall may then be constructed with a row of generally horizontal wall facing elements 22*a* along the primary face of the wall. Positioned generally parallel to but spaced rearwardly from the first row of wall facing elements 22*a* is an opposed row of wall facing elements 22*b*. The opposed wall facing elements 22*b* of the opposed row are positioned such that their frontal surfaces 44*b* are directed outwardly and oppositely to the direction of the frontal surfaces 44*a* of the elements 22*a*.

In this arrangement, a suitable conventional tensile element 92 may be attached to the lugs protruding from the rear of the elements 22*a* and the element 22*b*. By using a layer of tensile members 92 connecting the opposed wall facing elements 22*a*, 22*b*, (rather than the reinforcing member 30 of the earlier embodiment) the primary face can be erected in the manner previously described and an interior secondary face may be simultaneously provided. It will be noted that in this latter embodiment, where tensile members are used the wall facing elements will function as a conventional retaining wall and frictional stabilization of the particulate material deposited behind the wall is not assured.

In other applications (see FIG. 10), several rows of wall facing panels may be arranged as described above, with one or more horizontally extending terraces 94 located between vertical parts of the structure. The terrace 94 has a horizontal width which generally exceeds the horizontal distance between vertically adjacent wall facing elements. Other sections of the terraced retaining wall may then be erected progressing upwardly from the terrace 94. As noted above, the batter angle between successive rows of wall facing panels can be varied. Thus the terracing arrangement just described may also be thought of as a high batter angle between successive rows where the batter angle is relatively low. Moreover, it must be remembered that the lower batter angle can be 0° so that vertical wall face portions exist.

In addition, it will be appreciated that some of the ledges can have plantings while others are not provided with plantings. And, to reemphasize, the wall facing elements can have shapes other than rectangular.

In applications where the exposed wall face is high, it will sometimes be desirable to erect the wall face such that the weight of each wall facing element 22 is directly supported by the underlying wall face elements 22 in a columnar fashion. Toward this end, the wall facing element 22 (see FIG. 15) may be provided with a pair of bearing pads 100 which project from the rear face 48. Each bearing pad 100 is in general vertical alignment with a corresponding one of the buttresses 50, 52. In addition, each bearing pad 100 is provided with a bearing surface 102 which is generally parallel to and spaced vertically above the bearing surface 62 of the corresponding buttress 50, 52. The bearing surface 102 extends rearwardly from the back face 48 of the wall facing element 22 a distance sufficient to provide the necessary bearing area.

The bearing pad 100 also includes an edge face 104 which extends from the rearwardmost end of the bearing surface 102 in a direction generally parallel to the plane of the rear face 48 and downwardly away from the bearing surface 102. The bottom edge 106 of the bearing pad 100 may for example extend generally perpendicularly with respect to the rear face 48 of the wall facing element 22. The bottom face 106 of the bearing pad 100 is generally spaced from the mounting lug 64 which is attached to the reinforcing strip.

Each of the pair of bearing pads 100 (see FIG. 17) is spaced vertically below the upper edge 60 of the rear face 48 of the wall facing element 22 such that the vertical distance between the bearing surface 102 and the bearing surface 62 corresponds to the height of backfill to be covered by the wall facing element. The bearing pads 100 are preferably cast integrally with the wall facing element 22 and are positioned such that the upper bearing surfaces 102 of each of the bearing pads 100 are coplanar. In this fashion, when the buttress elements 50, 52 of a vertically adjacent panel rest on the bearing surfaces 102 of the bearing pads 100, the vertically adjacent wall facing element 22 is held in a level position.

Figure 15:
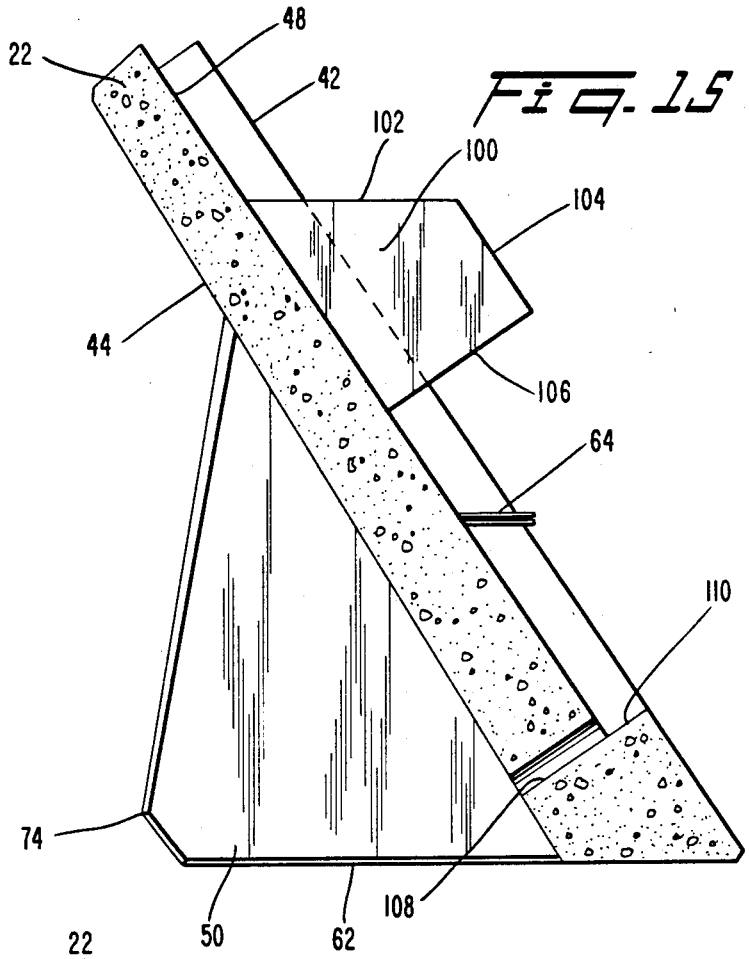
FIG. 15 is a cross-sectional view of a fourth embodiment of a wall facing element.
Figure 16:
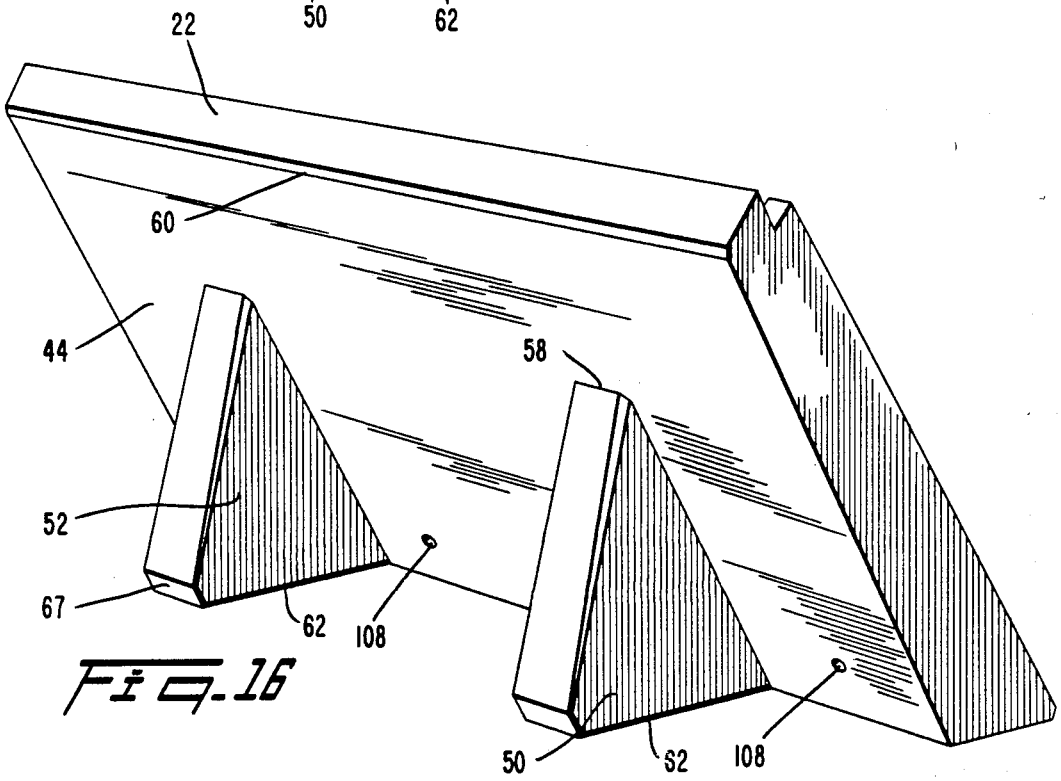
FIG. 16 is a perspective view of the facing element of FIG. 15 viewed from the front.

As best seen in FIG. 15, the wall facing element 22 may be provided with one or more drainage openings 108 which extend between the front face 44 and rear face 48. The cross-sectional configuration of each of the drainage openings 108 can be any desired cross section, however, a circular cross section is found to be suitable. The drainage openings 108 are preferably positioned such that they can receive water which collects along the back face 48 of the panel and above the collector edge 110 which extends generally horizontally across the rear face 48. Preferably, the drainage openings 108 are inclined vertically downwardly away from the collector edge 110 and open into the front face 44 of the wall facing element 22 (see FIG. 16).

The drainage openings 108 are desireably spaced from one another by a generally uniform distance (see FIG. 17). To provide a generally uniform drainage across the rear face 48 of the wall facing element 22, the spacing between the drainage openings 108 is preferably selected such that there are approximately four drainage openings for each wall facing element. In this fashion, not only does water drain freely from the backfill behind the wall facing element but any hydraulic pressures which might otherwise tend to develop behind the wall facing panel 22 are relieved.

In some configurations of the wall facing panel it may be desirable to increase the surface area which supports the wall facing element. When such an increased bearing area becomes desirable, it would be advantageous to increase the surface area 112 (see FIG. 19) at the base of the wall facing area 22. In such situations, it is permissible and desirable to provide a generally horizontally extending rib 114 which extends horizontally across the entire back face 48 of the wall facing element 22. The rib 114 projects rearwardly from the generally vertically extending ribs 42 provided at each side edge of the wall facing element 22. This extension in depth of the wall facing element adjacent its base provides an increase in the surface area of the bearing surface 112 for the wall facing element 22.

The construction of a wall from elements such as those illustrated in FIGS. 15, 16, 17 and 19 proceeds in the manner described above in the connection with the other embodiments. There is, however, one small difference which occurs in the construction sequence. More particularly, when a first course of wall facing elements 22 (See FIG. 18) has been placed, the backfill is installed and compacted to a level approximately coextensive with the bearing surface 102 of the bearing pads 100. At this time, a stiff bearing pad 116 is placed on top of the bearing surface 102. Next, the vertically adjacent course of wall facing elements 22' are positioned on the exposed surface of the backfill 118 such that the buttress portions 50, 52 are each supported on a corresponding pad 116 which, in turn, is supported by the bearing pad 100 of the vertically lower wall facing element 22. With such a construction sequence it will be apparent to those skilled in the art that, when the wall is completed, vertical forces caused by the weight of the wall facing elements as well as any superimposed loading is transmitted vertically downwardly through the buttress portions 50, 52 of one wall facing element 22' directly to the bearing pads 100 of the vertically subjacent wall facing panel 22. In like manner, those vertical loads are transmitted through the buttresses 50, 52 of the lower wall facing element 22 directly to bearing pads 100 of the next vertically lower wall facing element 22". In like manner though vertical loading is passed from the top of the wall to the lowermost wall facing and its buttress portions 50, 52.

It should now be apparent that a masked wall structure, a wall facing element adapted for use with frictionally stabilized earth structures that permits vegetative masking to be provided, and a method of building the wall have been described. It will be apparent to those skilled in the art that numerous modifications, variations, substitutions and equivalents may exist for various steps, features and elements of the invention which do not materially depart from the spirit and scope of this invention. Accordingly, all such modifications, variations, substitutions and equivalents which exist for the steps, elements and features of the invention as described in the appended claims are expressly intended to be embraced thereby.

What is claimed is:

1. A retaining wall structure comprising:

a plurality of wall facing elements, said elements being elongated and having upper and lower horizontal edges, opposing ends, front and rear faces and a substantially greater height than thickness, said facing elements being arranged in end to end relation in courses;

a plurality of reinforcing elements, said reinforcing elements including means for connecting a reinforcing element with a facing element, said reinforcing elements extending rearwardly from said facing elements in substantially horizontal layers;

particulate material interposed rearwardly of said facing elements and about said reinforcing elements, said particulate material being stabilized by frictional engagement between said material and said reinforcing elements;

said facing elements being in vertically adjacent courses defining a wall face, the facing elements in one course having the lower horizontal edge spaced rearwardly of the upper horizontal edge of the next lower course, a portion of said particulate material being situated between the lower edge of facing elements in one course and the rear face of the facing elements of the next lower course, said portion defining at least one strip suitable for use as a planting area, and said facing elements having a buttress projecting from said front face intermediate of said opposing ends, said buttress projecting toward, but spaced from, the upper edge of the facing element of the next lower course and being proportioned to permit a substantially vertical face; and wherein each facing element includes a bearing pad extending rearwardly from the facing element in general vertical alignment with the buttress such that the buttress of one wall facing element rests on the bearing pad of a second wall facing element.

2. The wall structure of claim 1 wherein:

a vertical joint exists between two adjacent wall facing panels;

each of the two wall facing panels include a rib, projecting rearwardly from the respective panel, extending substantially along the entire height of the vertical joint, and being adjacent to that joint; and a cover member having a U-shaped cross section covers the ribs adjacent to the joint and limits water drainage through the joint.

3. The wall structure of claim 1 wherein:

the buttress extends upwardly to a point spaced below the upper edge thereby giving an apparent lack of vertical support.

4. The wall structure of claim 1 wherein the buttress has greater thickness at the base thereof than at the top thereof so as to enlarge the bearing surface thereof.

5. The wall structure of claim 1 wherein each wall element has a pair of buttresses, the buttresses being spaced from one another by one half the wall element length and being spaced from the wall element end by one fourth of the wall element length so that the buttresses of vertically adjacent wall elements are in generally vertical alignment and so that the buttresses of sidewise adjacent wall elements are uniformly spaced from one another.

6. The wall structure of claim 1 further including an embankment of soil on each of the vertically spaced strips, the embankment extending upwardly and rearwardly from the edge of the wall facing panels.

7. The wall structure of claim 1 further including vegetation plantings in each of the vertically spaced strips whereby the vegetation substantially masks the face of the structure.

8. The wall structure of claim 1 wherein:

the structure has a top elevation and a height;

a second wall face is spaced rearwardly from the wall plane, extends to the same top elevation, and has a plurality of wall facing elements; and a portion of the plurality of reinforcing elements are attached to corresponding wall facing elements in the first and second wall faces.

9. The wall structure of claim 8 wherein the wall facing elements of the first and second wall faces are identical.

10. The wall structure of claim 8 wherein the second wall has a height which is less than the height of the first wall face.

11. The wall structure of claim 1 wherein a batter angle is defined between adjacent pairs of courses and wherein the batter angle is different between different pairs of courses.

12. A precast concrete element for use in the face of a retaining wall structure comprising:

a buttress having a generally flat supporting surface and a front portion;

a generally rectangular body portion having a frontal edge and a face surface extending downwardly from the frontal edge and defining an acute angle with a vertical plane passing through the frontal edge, the generally flat supporting surface of the buttress being disposed between the face surface and the vertical plane and protruding forwardly from the face surface;

a lug protruding from the back of the body portion, extending away from the buttress, and being operable to connect the element to another element of a retaining wall; and a bearing pad protruding from the back of the body portion in general vertical alignment with the buttress such that the bearing pad is positioned to support the buttress of a suprajacent facing element;

whereby the element is supported by the buttress such that the face surface is an inclined position relative to the vertical plane and such that the face surface defines an exposed generally flat planting area within the vertical projection of the element.

13. The precast concrete element of claim 12 further including a pair of ribs, each rib being located along a corresponding vertical edge of the body portion, projecting rearwardly away from the face surface and cooperating with one another to define a broad water-shedding channel behind the element.

14. The precast concrete element of claim 12 further including a pair of buttresses, each spaced from an adjacent vertical edge and from the other buttresses such that the buttresses appear to be uniformly spaced when a plurality of elements are located side-by-side.

* * * * *